US011047027B2

(12) United States Patent
Zhang et al.

(10) Patent No.: US 11,047,027 B2
(45) Date of Patent: Jun. 29, 2021

(54) 1500 MPA-GRADE STEEL WITH HIGH PRODUCT OF STRENGTH AND ELONGATION FOR VEHICLES AND MANUFACTURING METHODS THEREFOR

(71) Applicant: BAOSHAN IRON & STEEL CO., LTD., Shanghai (CN)

(72) Inventors: Yulong Zhang, Shanghai (CN); Qihang Han, Shanghai (CN); Li Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 209 days.

(21) Appl. No.: 16/320,235

(22) PCT Filed: Jul. 25, 2017

(86) PCT No.: PCT/CN2017/094247
§ 371 (c)(1),
(2) Date: Jan. 24, 2019

(87) PCT Pub. No.: WO2018/019220
PCT Pub. Date: Feb. 1, 2018

(65) Prior Publication Data

US 2019/0271064 A1 Sep. 5, 2019

(30) Foreign Application Priority Data

Jul. 27, 2016 (CN) ..... 201610601222.8

(51) Int. Cl.
*C22C 38/38* (2006.01)
*C21D 8/02* (2006.01)
(Continued)

(52) U.S. Cl.
CPC ..... *C22C 38/38* (2013.01); *C21D 1/26* (2013.01); *C21D 6/00* (2013.01); *C21D 8/02* (2013.01);
(Continued)

(58) Field of Classification Search
CPC ..... C22C 38/38; C22C 38/001; C22C 38/02; C21D 8/0263; C21D 2211/001; C21D 2211/008
See application file for complete search history.

(56) References Cited

U.S. PATENT DOCUMENTS

2014/0308156 A1 10/2014 Oh et al.
2017/0306437 A1* 10/2017 Nakagawa ..... C22C 38/14

FOREIGN PATENT DOCUMENTS

CN 101638749 2/2010
CN 102758133 10/2012
(Continued)

OTHER PUBLICATIONS

Office Action dated Aug. 14, 2020 for Korean Patent Application No. 20197004638.
(Continued)

*Primary Examiner* — Christopher S Kessler
*Assistant Examiner* — Jiangtian Xu
(74) *Attorney, Agent, or Firm* — Thomas Horstemeyer

(57) ABSTRACT

Provided are a 1500 MPa-grade steel with a high product of strength and elongation for vehicles and a manufacturing method thereof. The mass percentages of the chemical elements thereof are: 0.1-0.3% of C, 0.1-2.0% of Si, 7.5-12% of Mn, 0.01-2.0% of Al, and the balance of iron and other inevitable impurities. The microstructure of the steel with a high product of strength and elongation for vehicles is austenite+martensite+ferrite or austenite+martensite. The
(Continued)

steel for vehicles can reach a grade of 1500 MPa, and has a product of strength and elongation of no less than 30 GPa %.

9 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/34*** | (2006.01) |
| ***C21D 1/26*** | (2006.01) |
| ***C22C 38/18*** | (2006.01) |
| ***C21D 6/00*** | (2006.01) |

(52) U.S. Cl.

CPC ..... *C21D 8/0263* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/34* (2013.01); *C21D 8/0205* (2013.01); *C21D 8/0226* (2013.01); *C21D 8/0236* (2013.01); *C21D 2211/001* (2013.01); *C21D 2211/005* (2013.01); *C21D 2211/008* (2013.01)

(56) References Cited

FOREIGN PATENT DOCUMENTS

| | | |
|---|---|---|
| CN | 102912219 | 2/2013 |
| CN | 102925790 | 2/2013 |
| CN | 106244918 | 12/2016 |
| JP | 2017145468 | 8/2017 |
| JP | 6193219 | 9/2017 |
| JP | 2019523827 | 8/2019 |
| JP | 6625530 | 12/2019 |
| WO | 2012031771 | 3/2012 |
| WO | 2015102050 | 7/2015 |
| WO | 2016063467 | 4/2016 |

OTHER PUBLICATIONS

PCT Patent Application PCT/CN2017/094247 filed on Jul. 25, 2017, International Search Report and Written Opinion dated Feb. 1, 2018.

Office Action dated Feb. 18, 2020 for Japanese Patent Application No. 2019503712.

* cited by examiner

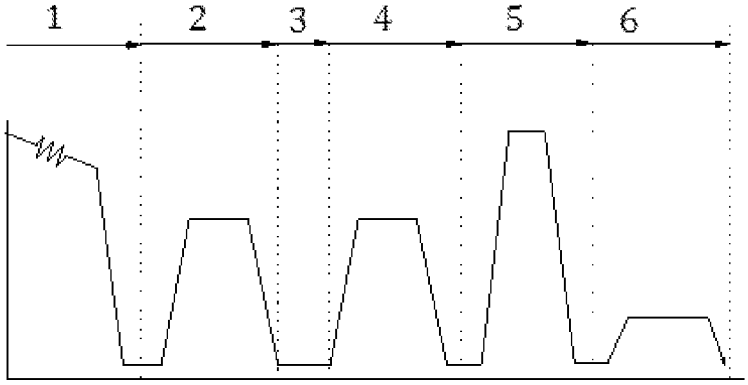
1
2
3
4
5
6

1500 MPA-GRADE STEEL WITH HIGH PRODUCT OF STRENGTH AND ELONGATION FOR VEHICLES AND MANUFACTURING METHODS THEREFOR

CROSS-REFERENCE TO RELATED APPLICATIONS

This application is a 371 U.S. National Phase of PCT International Application No. PCT/CN2017/094247 filed on Jul. 25, 2017, which claims benefit and priority to Chinese patent application no. 201610601222.8 filed on Jul. 27, 2016. Both of the above-referenced applications are incorporated by reference herein in their entireties.

TECHNICAL FIELD

The present disclosure relates to a steel type and a method of manufacturing the same as well as use of the same, particularly to steel for vehicles and a method of manufacturing the same.

BACKGROUND ART

Steel plates of ultrahigh strength are increasingly used in automotive structural members for "weight reduction" of vehicles. The largest product of strength and elongation of steel plates used nowadays in the largest amounts, such as dual-phase steel, martensitic steel, transformation induced plasticity steel (TRIP steel), complex phase steel, etc, is about 10 GPa %. For example, when a ultrahigh-strength martensitic steel has a tensile strength of 1500 MPa grade, its elongation rate is about 5%. This cannot meet the double requirements in the automotive field in terms of vehicle safety performance and formability in production. At the end of the last century, austenitic steel and twinning induced plasticity steel (TWIP steel) having high products of strength and elongation were developed successively. They exhibit a tensile strength of 800-1000 MPa, an elongation rate up to 60%, and a product of strength and elongation of 60 GPa % grade. They are called the second generation automotive steel. The second generation automotive steel incorporates large quantities of alloy elements, leading to high cost and poor manufacturability. This limits its popularization to a great extent. Hence, a low-cost third generation automotive steel having both high strength and high elongation which leads to a product of strength and elongation of greater than 30 GPa % attracts wide attention.

A Chinese patent literature having a publication number of CN101638749, a publication date of Feb. 3, 2010, and a title of "AUTOMOBILE STEEL WITH LOW COST AND HIGH PRODUCT OF STRENGTH AND ELONGATION AND PREPARATION METHOD THEREOF" discloses a method of manufacturing an automotive steel with a low cost and a high product of strength and elongation, wherein a cold rolled steel plate having a product of strength and elongation of 35-55 GPa % is obtained by a process route including smelting, hot rolling, bell furnace annealing, cold rolling and bell furnace annealing. In order to realize austenite reverse transformation to obtain a sufficient fraction by volume of austenite, a bell furnace is used for annealing after cold rolling, and the annealing time is 1-10 hours. However, the automotive steel strength obtained by this technical solution is 700-1300 MPa, not arriving at the 1500 MPa grade.

Another Chinese patent literature having a publication number of CN102758133A, a publication date of Oct. 31, 2012, and a title of "1000 MPA-GRADE AUTOMOTIVE STEEL WITH HIGH PRODUCT OF STRENGTH AND ELONGATION AND MANUFACTURING METHOD THEREOF" discloses a method of manufacturing a 1000 MPa-grade automotive steel with a high product of strength and elongation and a method of manufacturing the same, wherein a steel plate having a product of strength and elongation of greater than 30 GPa % is produced by a method employing continuous annealing. This method is suitable for the industrial production lines currently utilized in various steel makers. However, the automotive steel strength obtained by this technical solution is 1000 MPa, not arriving at the 1500 MPa grade.

In view of the above, enterprises desire an automotive steel material having a relatively high strength and a relatively good product of strength and elongation, useful for manufacturing automotive parts and meeting the demand of automotive steel. At the same time, enterprises further desire a method of manufacturing this automotive steel, wherein this method is characterized by a simple process flow and good applicability, useful for a variety of practical production lines.

SUMMARY

One object of the disclosure is to provide a 1500 MPa-grade automotive steel with a high product of strength and elongation, wherein the automotive steel has a strength that arrives at the 1500 MPa grade, and its product of strength and elongation is no less than 30 GPa %.

For the above object of the disclosure, the disclosure provides a 1500 MPa-grade automotive steel with a high product of strength and elongation, comprising chemical elements in percentage by mass of:

C: 0.1-0.3%, Si: 0.1-2.0%, Mn: 7.5-12%, Al: 0.01-2.0%, and a balance of iron and unavoidable impurities.

The 1500 MPa-grade automotive steel with a high product of strength and elongation comprises a microstructure of austenite+martensite+ferrite or austenite+martensite.

The principle for designing the various chemical elements in the 1500 MPa-grade automotive steel with a high product of strength and elongation according to the disclosure is described as follows:

Carbon: Carbon has an effect of solid solution strengthening. It's also a principal element for stabilizing austenite. It has a great influence on the strength, formability and weldability of the steel. If the mass percentage of carbon is lower than 0.1%, the strength of martensite in the structure will be low, such that the strength of the steel will be low, and the stability of austenite will be poor, leading to a low elongation rate. However, if the mass percentage of carbon is higher than 0.3%, the formability and weldability of the steel will be exasperated. Thus, the mass percentage of carbon in the 1500 MPa-grade automotive steel with a high product of strength and elongation according to the disclosure is controlled in the range of 0.1%-0.3%.

Silicon: Silicon is an essential element for deoxygenation in steel making. It also has some effect of solid solution strengthening. Meanwhile, silicon has a function of inhibiting precipitation of carbides. Hence, if the mass percentage of silicon is lower than 0.1%, the deoxygenating effect cannot be achieved fully. In addition, silicon has a function of preventing precipitation of cementite and promoting occurrence of martensite reverse transformation. Thus, when the mass percentage of silicon is higher than 2.0%, further increase of the silicon content will bring little additional benefit. As such, the mass percentage of silicon in the 1500

MPa-grade automotive steel with a high product of strength and elongation according to the disclosure is controlled in the range of 0.1%-2.0%.

Manganese: Manganese is an element capable of enlarging the austenitic phase zone. Diffusion of manganese as a result of heat treatment can increase the proportion of the austenitic phase and the austenite stability. In the technical solution according to the disclosure, manganese is a principal element for controlling the size, distribution and stability of reversely transformed martensite. If the mass percentage of manganese is less than 7.5%, a sufficient amount of austenite can hardly be obtained at room temperature. However, if the mass percentage of manganese is greater than 12%, some c martensite will be obtained at room temperature, which is undesirable for steel performances. In order to guarantee the steel's strength and toughness, the mass percentage of manganese in the 1500 MPa-grade automotive steel with a high product of strength and elongation according to the disclosure is controlled in the range of 7.5-12%.

Al: Aluminum has an effect of deoxygenation in steel making. It's an element that is added for increasing the purity of molten steel. At the same time, aluminum can also immobilize nitrogen in the steel by allowing it to form stable compounds, thereby refining grains effectively. Additionally, aluminum added in the steel has a function of preventing precipitation of cementite and promoting martensite reverse transformation. If the mass percentage of aluminum is less than 0.01%, the effect brought about by the addition of aluminum is not obvious. As such, the mass percentage of aluminum in the 1500 MPa-grade automotive steel with a high product of strength and elongation according to the disclosure is controlled in the range of 0.01%-2.0%.

Additionally, in order to allow the strength of the automotive steel to arrive at the 1500 MPa grade and the product of strength and elongation to be no less than 30 GPa %, the 1500 MPa-grade automotive steel with a high product of strength and elongation according to the disclosure limits the microstructure to austenite+martensite+ferrite or austenite+martensite.

It should be noted that, based on the above technical solution, the unavoidable impurities in the 1500 MPa-grade automotive steel with a high product of strength and elongation according to the disclosure mainly refer to phosphorus, sulfur and nitrogen, wherein these impurity elements may be controlled as: P≤0.02%, S≤0.02%, N≤0.02%.

Further, the 1500 MPa-grade automotive steel with a high product of strength and elongation according to the disclosure also comprises at least one chemical element of Nb: 0.01-0.07%, Ti: 0.02-0.15%, V: 0.05-0.20%, Cr: 0.15-0.50%, Mo: 0.10-0.50%.

Addition of alloy elements aims to further improve the performances of the 1500 MPa-grade automotive steel with a high product of strength and elongation according to the disclosure, wherein the design principle is described as follows:

Niobium: Niobium can effectively delay recrystallization of deformed austenite, prevent austenite grains from growing large, increase the recrystallization temperature of austenite, refine grains and promote both strength and elongation. If the mass percentage of niobium is less than 0.01%, the desired effects cannot be achieved. However, if the mass percentage of niobium is greater than 0.07%, production cost will be increased, while the effect on improving steel performances is no longer noticeable. Therefore, in the technical solution according to the disclosure, the mass percentage of niobium is controlled in the range of 0.01-0.07%.

Titanium: Titanium forms fine carbide compounds, prevents austenite grains from growing large, refine grains, and also has an effect of precipitation strengthening. While the steel strength is improved, the elongation rate and the hole expansion ratio are not decreased. If the mass percentage of titanium is less than 0.02%, there will be no effect of grain refining or precipitation strengthening. However, if the mass percentage of titanium is greater than 0.15%, further increase of the titanium content will have no noticeable effect on improving the steel. As such, the mass percentage of titanium in the 1500 MPa-grade automotive steel with a high product of strength and elongation according to the disclosure is controlled in the range of 0.02%-0.15%.

Vanadium: The function of vanadium is to form carbides and improve the steel strength. If the mass percentage of vanadium is less than 0.05%, the effect of precipitation strengthening will not be noticeable. However, if the mass percentage of vanadium is greater than 0.20%, further increase of the vanadium content will have no noticeable effect on improving the steel. As such, the mass percentage of vanadium in the 1500 MPa-grade automotive steel with a high product of strength and elongation according to the disclosure is controlled in the range of 0.05%-0.20%.

Chromium: Chromium facilitates refining of austenite grains and formation of fine bainite during rolling, and improves the steel strength. If the mass percentage of chromium is less than 0.15%, the effect will not be noticeable. However, if the mass percentage of chromium exceeds 0.5%, the cost will be increased, and the weldability will be degraded significantly. As such, the mass percentage of chromium in the 1500 MPa-grade automotive steel with a high product of strength and elongation according to the disclosure is controlled in the range of 0.15%-0.50%.

Molybdenum: Molybdenum facilitates refining of austenite grains and formation of fine bainite during rolling, and improves the steel strength. If the mass percentage of molybdenum is less than 0.15%, the effect will not be noticeable. However, if the mass percentage of molybdenum exceeds 0.5%, the cost will be increased, and the weldability will be degraded significantly. As such, the mass percentage of molybdenum in the 1500 MPa-grade automotive steel with a high product of strength and elongation according to the disclosure is controlled in the range of 0.15%-0.50%.

Further, in the 1500 MPa-grade automotive steel with a high product of strength and elongation according to the disclosure, when the microstructure is austenite+martensite+ferrite, a phase of the austenite has a proportion of 20%-40%, and a phase of the martensite has a proportion of 50%-70%.

Further, in the 1500 MPa-grade automotive steel with a high product of strength and elongation according to the disclosure, when the microstructure is austenite+martensite, a phase of the austenite has a proportion of 20%-50%.

Further, the 1500 MPa-grade automotive steel with a high product of strength and elongation according to the disclosure has a product of strength and elongation of no less than 30 GPa %.

The 1500 MPa-grade automotive steel with a high product of strength and elongation according to the disclosure has a tensile strength of greater than 1500 MPa and a product of strength and elongation of no less than 30 GPa %. Therefore, this automotive steel meets the requirements of weight reduction and high strength of modern automotive steel.

Another object of the disclosure is to provide a manufacturing method for the 1500 MPa-grade automotive steel with a high product of strength and elongation according to the disclosure, comprising the following steps in order:

(1) Smelting and casting;

(2) Hot rolling;

(3) Bell furnace annealing, wherein an annealing temperature is 600-700° C., and an annealing time is 1-48 h;

(4) Cold rolling;

(5) First post-cold-rolling annealing: an annealing temperature is between Ac1 and Ac3 temperatures, and an annealing time is greater than 5 min;

(6) Second post-cold-rolling annealing: an annealing temperature is 750-850° C., and an annealing time is 1-10 min;

(7) Tempering: a tempering temperature is 200-300° C., and a tempering time is no less than 3 min.

In the manufacturing method for the 1500 MPa-grade automotive steel with a high product of strength and elongation according to the disclosure, since the mass percentage of Mn is 7.5-12%, the inventors hope to utilize an austenite reverse transformation (ART) annealing process to obtain a high product of strength and elongation. The principle of the ART annealing is as follows: by controlling the design of the chemical composition of a steel plate and the process parameters, the steel acquires a pure martensitic structure after hot rolling and cold rolling; in the subsequent annealing (the annealing temperature is between the Ac1 and Ac3 temperatures), martensite reverse transformation is promoted to form some austenite. Due to partition of carbon and manganese elements and their enrichment in the austenite, the austenite can exist stably at room temperature. By way of the ART annealing, an austenitic structure can be obtained at room temperature. Under the effect of stress, the austenite will undergo stress/strain induced martensitic transformation, and so-called transformation induced plasticity (TRIP) will be developed, thereby improving the performances of the steel plate.

However, in general, a conventional ART annealing temperature is only slightly higher than an Ac1 temperature, and a microstructure of austenite+ferrite is obtained after the annealing. The strength of a steel having this kind of microstructure can by no means reach 1500 MPa, and thus cannot meet the requirement of the technical solution according to the disclosure. If the annealing temperature is increased, a microstructure of ferrite+martensite+austenite can be obtained. However, the austenite in this microstructure is not stable. If transformation takes place when the stress is small, the TRIP effect will not occur, such that the steel plate will have a low elongation rate, and a high product of strength and elongation cannot be achieved.

After study, the inventors have discovered that, to obtain a 1500 MPa-grade steel plate having a high product of strength and elongation, the microstructure must comprise a large amount of martensite, and also comprise much austenite having relatively high stability. For this purpose, the inventors have proposed inventively an annealing process based on the compositional design according to the disclosure, so that the microstructure in the steel comprises much austenite having relatively high stability in addition to a large amount of martensite.

In step (2) in the manufacturing method for the 1500 MPa-grade automotive steel with a high product of strength and elongation according to the disclosure, the microstructure after the hot rolling is martensite. Martensite has a high strength, but it's relatively brittle. Hence, before the cold rolling in step (4), the steel is softened by the bell furnace annealing in step (3). In the cold rolling in step (4), austenite transforms to martensite. By further adjusting the microstructure in the steel in steps (5), (6) and (7), the 1500 MPa-grade automotive steel with a high product of strength and elongation is obtained.

The bell furnace annealing in step (3) and the first post-cold-rolling annealing in step (5) are both ART annealing, wherein the annealing temperatures are between the Ac1 and Ac3 temperatures. The purpose of the first post-cold-rolling annealing in step (5) is to transform the martensite in the microstructure of the steel plate after the cold rolling to austenite plus ferrite by the ART annealing, so as to make preparation for subsequent processes.

Particularly, the second post-cold-rolling annealing in step (6) according to the present technical solution employs a relatively high annealing temperature (close to the Ac3 temperature in the dual-phase zone or single-phase austenitic zone), and a relatively short annealing time. The aim and principle are as follows: the microstructure of the steel plate obtained after the first post-cold-rolling annealing in step (5) is ferrite+austenite; the austenite structure contains a high amount of Mn and thus possesses good stability. At this point, when the steel plate is heated to a relatively high temperature, the ferrite structure in the original steel plate transforms to a new austenitic phase. This newly formed austenitic phase contains a relatively low amount of Mn. In addition, Mn has a relatively low diffusion rate, and thus Mn cannot diffuse fully in the short period of time of annealing. Therefore, austenites having two different compositions are developed in the structure at high temperatures, namely Mn-rich austenite and Mn-lean austenite. After cooled to room temperature, the Mn-lean austenite transforms to martensite, and the Mn-rich austenite still exists stably. In this way, a large quantity of martensite and highly stable austenite are obtained.

Therefore, when the annealing temperature of the second post-cold-rolling annealing in step (6) resides in the dual-phase zone, a microstructure of martensite+austenite+a minute amount of ferrite will be obtained by controlling the annealing temperature and time; when the annealing temperature of the second post-cold-rolling annealing in step (6) resides in the single-phase austenitic zone, a microstructure of martensite+austenite will be obtained by controlling the annealing temperature and time.

As such, in the technical solution according to the disclosure, the annealing temperature in step (6) is limited to 750-850° C., and the annealing time is controlled in the range of 1-10 min. If the annealing temperature is higher than 850° C. or the annealing time is longer than 10 min, the austenite will become less stable, and the proportion of the austenitic phase at room temperature will be low, such that the product of strength and elongation of the steel is less than 30 GPa %. However, if the annealing temperature is lower than 750° C. or the annealing time is shorter than 1 min, less ferrite will transform to austenite during the annealing, and a large amount of ferrite will still exist after the steel is cooled to room temperature. In this case, although the elongation rate and the product of strength and elongation of the steel may be relatively high, the strength of the steel cannot reach 1500 MPa.

The purpose of the tempering in step (7) is to remove the internal stress generated when the martensite is formed. Without the tempering, the resulting steel plate will be brittle, and the elongation rate will be low.

Further, in the manufacturing method for the 1500 MPa-grade automotive steel with a high product of strength and elongation according to the disclosure, in step (2), a cast blank is heated to 1100-1260° C., and then the rolling is performed under control, wherein a blooming temperature is 950-1150° C., a final rolling temperature is 750-900° C., and a coiling temperature is 500-850° C., wherein a pure martensitic structure is obtained after the steel is cooled to room temperature after coiling.

Further, in the manufacturing method for the 1500 MPa-grade automotive steel with a high product of strength and elongation according to the disclosure, in step (4), a cold rolling reduction is no less than 40%.

Further, in the manufacturing method for the 1500 MPa-grade automotive steel with a high product of strength and elongation according to the disclosure, an acid pickling step exists between steps (3) and (4). This step is performed to remove mill scale generated in the hot rolling.

The 1500 MPa-grade automotive steel with a high product of strength and elongation according to the disclosure may have a tensile strength of 1500 MPa or higher, and its product of strength and elongation may be 30 GPa % or higher.

The manufacturing method for the 1500 MPa-grade automotive steel with a high product of strength and elongation according to the disclosure also possesses the above advantages and beneficial effects. In addition, the manufacturing method optimizes the process flow and improves steel performances by way of rational design of the chemical composition and control over the annealing process, thereby obtaining an automotive steel with a high product of strength and elongation that meets relevant requirements. Furthermore, the manufacturing cost is reduced.

DESCRIPTION OF THE DRAWING

FIG. 1 is a schematic view showing a process curve of the manufacturing method for the 1500 MPa-grade automotive steel with a high product of strength and elongation according to the disclosure.

DETAILED DESCRIPTION

The 1500 MPa-grade automotive steel with a high product of strength and elongation and the manufacturing method thereof according to the disclosure will be further explained and illustrated with reference to the accompanying drawing and the specific examples. Nonetheless, the explanation and illustration are not intended to unduly limit the technical solution of the disclosure.

Examples 1-8 and Comparative Examples 1-4

The 1500 MPa-grade automotive steel with a high product of strength and elongation in Examples 1-8 and the steel plates in Comparative Examples 1-4 were manufactured according to the following steps:

(1) Smelting and casting: A converter was used for the smelting, and the mass percentages of the various chemical elements were controlled as shown by Table 1.

(2) Hot rolling: A cast blank was heated to 1100-1260° C., and then rolled under control, wherein a blooming temperature was 950-1150° C., a final rolling temperature was 750-900° C., and a coiling temperature was 500-850° C. After coiling and after cooling to room temperature, a pure martensitic structure was obtained.

(3) Bell furnace annealing, wherein an annealing temperature was 600-700° C., and an annealing time was 1-48 h.

(4) Cold rolling: A cold rolling reduction was not less than 40%.

(5) First post-cold-rolling annealing: an annealing temperature was between Ac1 and Ac3 temperatures, and an annealing time was greater than 5 min.

(6) Second post-cold-rolling annealing: an annealing temperature was 750-850° C., and an annealing time was 1-10 min. It should be noted that, in order to demonstrate the influence of the process parameters of the second post-cold-rolling annealing defined by this disclosure on the implementing effects of this disclosure, the annealing temperatures used in Comparative Examples 1-3 were outside of the scope defined by this disclosure, wherein the annealing temperature of the second post-cold-rolling annealing in Comparative Example 1 was 720° C., the annealing time of the second post-cold-rolling annealing in Comparative Example 2 was 15 min, and the annealing temperature of the second post-cold-rolling annealing in Comparative Example 3 was 760° C.

(7) Tempering: a tempering temperature was 200-300° C., and a tempering time was no less than 3 min.

In addition, it should be noted that the thickness of the hot-rolled steel plate in step (2) was not greater than 8 mm. The thickness of the cold-rolled steel plate in step (4) was not greater than 2.5 mm.

In addition, it should be noted that, in other embodiments, an electric furnace or an induction furnace may be utilized for the smelting in step (1).

In addition, it should be noted that, in other embodiments, preferably, an acid pickling step may further exist between steps (3) and (4).

Table 1 lists the mass percentages of the various chemical elements in Examples 1-8 and Comparative Examples 1-4.

TABLE 1

(wt %, the balance being Fe and impurity elements other than impurity elements S, P and N)

| Composition Number | C | Si | Mn | Al | P | N | S | Other Elements |
|---|---|---|---|---|---|---|---|---|
| A | 0.25 | 1.86 | 8.19 | 0.038 | 0.010 | 0.004 | 0.007 | Cr = 0.41% |
| B | 0.29 | 0.68 | 7.91 | 0.042 | 0.014 | 0.003 | 0.004 | V = 0.19% |
| C | 0.14 | 0.18 | 9.88 | 1.56 | 0.015 | 0.005 | 0.009 | — |
| D | 0.12 | 0.25 | 8.46 | 0.045 | 0.010 | 0.005 | 0.005 | Nb = 0.06%, Ti = 0.12% |
| E | 0.19 | 0.64 | 11.27 | 1.82 | 0.011 | 0.004 | 0.004 | Mo = 0.18% |
| F | 0.16 | 0.25 | 6.57 | 0.031 | 0.009 | 0.004 | 0.005 | — |

Table 2 lists the specific process parameters of the manufacturing method in Examples 1-8 and Comparative Examples 1-4.

TABLE 2

| | | Step (2) | | | | Step (3) | |
|---|---|---|---|---|---|---|---|
| | | | | Final | | | |
| | Composition number | Heating Temperature (° C.) | Blooming Temperature (° C.) | Rolling Temperature (° C.) | Coiling Temperature (° C.) | Annealing Temperature (° C.) | Annealing Time (h) |
| Ex. 1 | A | 1170 | 1100 | 850 | 700 | 600 | 12 |
| Ex. 2 | B | 1230 | 1070 | 830 | 650 | 630 | 12 |
| Ex. 3 | C | 1180 | 1080 | 890 | 730 | 630 | 12 |
| Ex. 4 | C | 1190 | 1110 | 870 | 500 | 620 | 24 |
| Ex. 5 | C | 1230 | 1100 | 880 | 840 | 650 | 48 |
| Ex. 6 | C | 1230 | 1130 | 890 | 560 | 600 | 1 |
| Ex. 7 | D | 1220 | 1100 | 860 | 640 | 640 | 24 |
| Ex. 8 | E | 1200 | 1120 | 870 | 600 | 650 | 12 |
| Comp. Ex. 1 | B | 1230 | 1105 | 865 | 600 | 650 | 12 |
| Comp. Ex. 2 | C | 1200 | 1140 | 830 | 650 | 700 | 12 |
| Comp. Ex. 3 | D | 1250 | 1120 | 890 | 650 | 650 | 1 |
| Comp. Ex. 4 | F | 1220 | 1090 | 845 | 650 | 660 | 48 |

| | Step (4) | Step (5) | | Step (6) | | Step (7) | |
|---|---|---|---|---|---|---|---|
| | Cold Rolling Reduction (%) | Annealing Temperature (° C.) | Annealing Time (min) | Annealing Temperature (° C.) | Annealing Time (min) | Tempering Temperature (° C.) | Tempering Time (min) |
| Ex. 1 | 40 | 620 | 720 | 750 | 1 | 200 | 5 |
| Ex. 2 | 50 | 640 | 30 | 770 | 3 | 240 | 3 |
| Ex. 3 | 70 | 650 | 60 | 820 | 3 | 300 | 3 |
| Ex. 4 | 60 | 620 | 10 | 810 | 5 | 260 | 5 |
| Ex. 5 | 60 | 650 | 5 | 820 | 2 | 220 | 3 |
| Ex. 6 | 60 | 650 | 360 | 830 | 5 | 200 | 3 |
| Ex. 7 | 60 | 680 | 60 | 790 | 10 | 260 | 5 |
| Ex. 8 | 55 | 600 | 120 | 790 | 1 | 220 | 5 |
| Comp. Ex. 1 | 60 | 690 | 120 | 720 | 1 | 200 | 3 |
| Comp. Ex. 2 | 70 | 620 | 360 | 820 | 15 | 240 | 3 |
| Comp. Ex. 3 | 65 | 640 | 720 | 860 | 6 | 220 | 5 |
| Comp. Ex. 4 | 60 | 650 | 30 | 800 | 5 | 210 | 5 |

It should be noted that the composition numbers for the Examples and Comparative Examples in Table 2 refer to the corresponding composition numbers in Table 1.

The 1500 MPa-grade automotive steel with a high product of strength and elongation in Examples 1-8 and the steel plates in Comparative Examples 1-4 were sampled for testing of various properties. The relevant property parameters obtained by the testing are listed in Table 3.

Table 3 lists the property parameters of the 1500 MPa-grade automotive steel with a high product of strength and elongation in Examples 1-8 and the steel plates in Comparative Examples 1-4. The product of strength and elongation is a product of tensile strength and elongation rate.

TABLE 3

| | Yield Strength ReL (MPa) | Tensile Strength Rm (MPa) | Elongation Rate A50 (%) | Product of Strength and Elongation (GPa %) | Proportion of Austenitic Phase (%) | Proportion of Martensitic Phase (%) |
|---|---|---|---|---|---|---|
| Ex. 1 | 908 | 1623 | 19.8 | 32.1 | 23 | 65 |
| Ex. 2 | 895 | 1668 | 18.1 | 30.2 | 29 | 67 |
| Ex. 3 | 856 | 1559 | 25.6 | 39.9 | 35 | 65 |
| Ex. 4 | 837 | 1546 | 23.8 | 36.8 | 40 | 60 |
| Ex. 5 | 769 | 1601 | 20.6 | 33.0 | 28 | 72 |
| Ex. 6 | 953 | 1643 | 18.7 | 30.7 | 22 | 78 |
| Ex. 7 | 821 | 1512 | 26.8 | 40.5 | 31 | 69 |
| Ex. 8 | 789 | 1587 | 22.2 | 35.2 | 43 | 57 |
| Comp. Ex. 1 | 668 | 1132 | 30.8 | 34.9 | 28 | 41 |

TABLE 3-continued

| | Yield Strength ReL (MPa) | Tensile Strength Rm (MPa) | Elongation Rate A50 (%) | Product of Strength and Elongation (GPa %) | Proportion of Austenitic Phase (%) | Proportion of Martensitic Phase (%) |
|---|---|---|---|---|---|---|
| Comp. Ex. 2 | 901 | 1591 | 16.5 | 26.3 | 16 | 84 |
| Comp. Ex. 3 | 1001 | 1783 | 12.4 | 22.1 | 7 | 93 |
| Comp. Ex. 4 | 1048 | 1653 | 15.6 | 25.8 | 13 | 87 |

As shown by Table 3, the 1500 MPa-grade automotive steel with a high product of strength and elongation in the inventive Examples had a tensile strength >1500 MPa, and a product of strength and elongation >30 GPa %, which demonstrates that the automotive steel in the Examples possessed high strength and good tensile ductility.

As shown by Tables 1 and 3 in combination, the mass percentage of manganese in Comparative Example 4 was less than 7.5%. Its product of strength and elongation failed to arrive at 30 GPa %, and its elongation rate was low. The reason for this is that the mass percentage of manganese in Comparative Example 4 was low, so that the proportion of the austenitic phase generated in the second post-cold-rolling annealing was not high enough and the austenitic phase was not sufficiently stable, leading to a low elongation rate, and thus a low product of strength and elongation.

As shown by Tables 2 and 3 in combination, the annealing temperature of the second post-cold-rolling annealing in Comparative Example 1 was lower than 750° C. As a result, less ferrite transformed to austenite in the second post-cold-rolling annealing, and a large amount of ferrite still existed after cooling to room temperature. Thus, the elongation rate of the steel plate in Comparative Example 1 was greater than 30%, the product of strength and elongation was greater than 30 GPa %, but its tensile strength was lower than 1500 MPa.

Again, as shown by Tables 2 and 3 in combination, the annealing time of the second post-cold-rolling annealing in Comparative Example 2 was longer than 10 min, and the annealing temperature of the second post-cold-rolling annealing in Comparative Example 3 was higher than 850° C. As a result, the austenite became less stable, and the proportion of the austenitic phase at room temperature was low. The products of strength and elongation of the steel plates in Comparative Examples 2 and 3 were both less than 30 GPa %.

FIG. 1 is a schematic view showing a process curve of the manufacturing method for the 1500 MPa-grade automotive steel with a high product of strength and elongation in Example 1 according to the disclosure.

As shown by FIG. 1, the manufacturing process in the technical solution according to the disclosure includes a first annealing after hot rolling 1, i.e. bell furnace annealing 2; cold rolling 3; a second annealing after the cold rolling, i.e. a first post-cold-rolling annealing 4; then a third annealing, i.e. a second post-cold-rolling annealing 5; and finally tempering 6. The horizontal axis in FIG. 1 represents time, and the vertical axis represents temperature. Hence, the curve in FIG. 1 schematically shows temperature as a function of time. As shown by FIG. 1, the bell furnace annealing 2 and the first post-cold-rolling annealing 4 employ common ART annealing, while the second post-cold-rolling annealing 5 employs a higher annealing temperature and a shorter annealing time as compared with the common ART annealing. Consequently, a microstructure desired by the present disclosure is obtained, i.e. a combination of a large quantity of martensitic structure and a relatively large amount of austenitic structure.

It is to be noted that there are listed above only specific examples of the invention. Obviously, the invention is not limited to the above examples. Instead, there exist many similar variations. All variations derived or envisioned directly from the disclosure of the invention by those skilled in the art should be all included in the protection scope of the invention.

The invention claimed is:

1. An automotive steel with a high product of strength and elongation, with chemical elements in percentage by mass being:

C: 0.1-0.3%, Si: 0.1-2.0%, Mn: 7.5-12%, Al: 0.01-2.0%, and a balance of iron and unavoidable impurities, wherein the automotive steel with a high product of strength and elongation comprises a microstructure of austenite+martensite+ferrite, wherein the phase of austenite has a proportion of 20%-40%, and the phase of the martensite has a proportion of 50%-70%, or the automotive steel with a high product of strength and elongation comprises a microstructure of austenite+martensite, wherein the phase of the austenite has a proportion of 20%-50%;

wherein the tensile strength of the automotive steel with a product of strength and elongation is >1500 MPa, and its product of strength and elongation is ≥30 GPa %.

2. The automotive steel of claim 1, further comprising at least one chemical element of Nb: 0.01-0.07%, Ti: 0.02-0.15%, V: 0.05-0.20%, Cr: 0.15-0.50%, and Mo: 0.10-0.50%.

3. A method for manufacturing the automotive steel of claim 1, comprising the following steps in order:

(1) Smelting and casting;

(2) Hot rolling;

(3) Bell furnace annealing, wherein an annealing temperature is 600-700° C., and an annealing time is 1-48 h;

(4) Cold rolling;

(5) First post-cold-rolling annealing: an annealing temperature is between Ac1 and Ac3 temperatures, and an annealing time is greater than 5 min;

(6) Second post-cold-rolling annealing: an annealing temperature is 750-850° C., and an annealing time is 1-10 min;

(7) Tempering: a tempering temperature is 200-300° C., and a tempering time is no less than 3 min.

4. The manufacturing method of claim 3, wherein in step (2), a cast blank is heated to 1100-1260° C., and then rolled under control, wherein a blooming temperature is 950-1150° C., a final rolling temperature is 750-900° C., and a coiling temperature is 500-850° C., wherein a pure martensitic structure is obtained after cooling to room temperature after the coiling.

5. The manufacturing method of claim 3, wherein in step (4), a cold rolling reduction is not less than 40%.

6. The manufacturing method of claim 3, wherein an acid pickling step exists between steps (3) and (4).

7. The method for manufacturing the automotive steel of claim 3, wherein the automotive steel further comprises at least one chemical element of Nb: 0.01-0.07%, Ti: 0.02-0.15%, V: 0.05-0.20%, Cr: 0.15-0.50%, and Mo: 0.10-0.50%.

8. The manufacturing method of claim 3, wherein the microstructure of the automotive steel is austenite+martensite+ferrite with a proportion of the austenite phase being 20%-40%, and a proportion of the martensite phase being 50%-70%.

9. The manufacturing method of claim 3, wherein the microstructure of the automotive steel is austenite+martensite with a proportion of the austenite phase being 20%-50%.

* * * * *